US007481327B2

(12) United States Patent
Cheng

(10) Patent No.: US 7,481,327 B2
(45) Date of Patent: Jan. 27, 2009

(54) COMBINED STORAGE BASKET

(76) Inventor: Hsi Ming Cheng, No. 99, Juhe Road, Chu Wei Villgae, Pitou Hsiang, Changhua Hsien (TW)

( * ) Notice: Subject to any disclaimer, the term of this patent is extended or adjusted under 35 U.S.C. 154(b) by 268 days.

(21) Appl. No.: 11/604,780

(22) Filed: Nov. 28, 2006

(65) Prior Publication Data

US 2008/0121638 A1 May 29, 2008

(51) Int. Cl.
*B65D 6/24* (2006.01)
*B65D 90/08* (2006.01)
*B65D 21/032* (2006.01)

(52) U.S. Cl. ..... 220/4.33; 206/509; 220/622; 220/676; 220/693

(58) Field of Classification Search ..... 220/4.28, 220/491, 4.33, 622, 693, 676, 692; 206/509, 206/510

See application file for complete search history.

(56) References Cited

U.S. PATENT DOCUMENTS 2,923,432 A * 2/1960 Stanley ..... 206/431
3,704,791 A * 12/1972 Young, Jr. ..... 211/126.9
3,750,936 A * 8/1973 Crane ..... 206/510
4,079,836 A * 3/1978 Von Stein et al. ..... 206/513
4,146,139 A * 3/1979 von Stein et al. ..... 211/126.9
4,298,127 A * 11/1981 Upshaw et al. ..... 211/126.9
4,821,885 A * 4/1989 Ondrasik ..... 206/513
5,871,115 A * 2/1999 Kohn ..... 220/485
6,419,103 B1 * 7/2002 Wang ..... 220/4.33

* cited by examiner

*Primary Examiner*—Anthony D Stashick
*Assistant Examiner*—Niki M Eloshway
(74) *Attorney, Agent, or Firm*—Bacon & Thomas, PLLC

(57) ABSTRACT

A combined storage basket allowing firm combination secured in position with bolts in prefabricated bolting holes for easy combination includes a base, a back, and two side grid panels; the basket has an open front; the base panel is placed on the bottom skirt of the back panel, the back panel slides into and is then bolted to inner side skirts of both side panels; and the back panel and the base panel are secured with bolts to both side panels; a rectangular frame in a width greater than that of the base panel is disposed beneath the base panel; and a vertical frame in Π shape is disposed to the back of each side panel with the top of vertical frame at a level higher than that of the top of the side panel to allow stacking up of multiple units of the basket.

2 Claims, 4 Drawing Sheets

COMBINED STORAGE BASKET

BACKGROUND OF THE INVENTION (a) Field of the Invention

The present invention is related to an improved construction of a combined storage basket, and more particularly, to a grid storage basket by having plate frame to replace rod frame for each composite panel of the prior art to provide better combination reliability of the frame and panel; and the combined basket is bolted in position with prefabricated skirts and bolting holes to each panel; the base panel is placed on the bottom skirts of the back panel first, then the back panel is secured to both side panels with rear skirts of both side panels; then and both side panels and is secured with bolts to the bottom skirts of both side panels.

(b) Description of the Prior Art

Conventional grid type storage basket usually comprised of multiple grid materials integrated with frames before being incorporated with a base panel though featuring simple construction and assembly consumes larger space either in ex-factory packaging, shipping and warehousing to result in comparatively higher costs to fail economic benefits.

A combined storage basket has been developed for improvement, wherein a base panel, a back panel, a front panel, and two side panels are made in separate parts and allow easy assembly by its end user to significantly reduce packaging space thus to reduce packaging, shipping, and warehousing costs.

However, the grid panel must be cut into a specific size to be inserted into and soldered to a rod frame. The soldering process consumes too much time and the quality is questionable. As a result, the grid panel can easily break away from its frame, particularly when subject to the impact of external force.

To bolt the panel to its frame, locating members must be separately soldered to the frame. While causing additional labor and time costs, the locating member is vulnerable to dislocation due to absence of a corresponding positioning member. Dislocated locating members prevent alignment with bolting holes to frustrate subsequent bolting process.

Furthermore, the front panel and the lower portion of the back panel usually must hold the base panel in the beginning of erecting the combined storage basket before the front panel and the back panel are held by both side panels; and finally, bolts are locked up at the prefabricated locating members to complete the erection. Accordingly, the basket is not firmly secured since the base panel is simply held by the front panel and the lower portion of the back panel; and the basket tends to shake and slacken, thus to significantly affect the firm construction of the basket, and endanger the safety and stability of the contents therein.

SUMMARY OF THE INVENTION

The primary purpose of the present invention is to provide a combined storage basket with all composite members knocked down ex-factory for saving shipping space and later to be assembled on site in a better secured construction.

Another purpose of the present invention is to provide a combined storage basket that allows upgraded quality for each composite member in a simplified manufacturing process by having prefabricated bolting holes and skirts to the frame of each panel to secure the basket with bolts.

To achieve these purposes, the present invention is comprised of a base panel, a back panel, and two side panels. The peripheral of each panel is plate framed to replace the rod frame of the prior art for more reliable combination between the grid panel and its frame. The back panel is disposed with a bottom skirt and two bolting holes. Each side panel is integrated with a rear skirt and a bottom skirt; and one bolting hole and two bolting holes are respectively disposed on the rear skirt and the bottom skirt of each side panel. The back panel slides into rear skirts of both side panels and secured with bolts, and the base panel restricted by the bottom skirt of the back panel and bottom skirts of both side panels is also secured in position with bolts to both side panels.

DETAILED DESCRIPTION OF THE PREFERRED EMBODIMENTS

Figure 1:
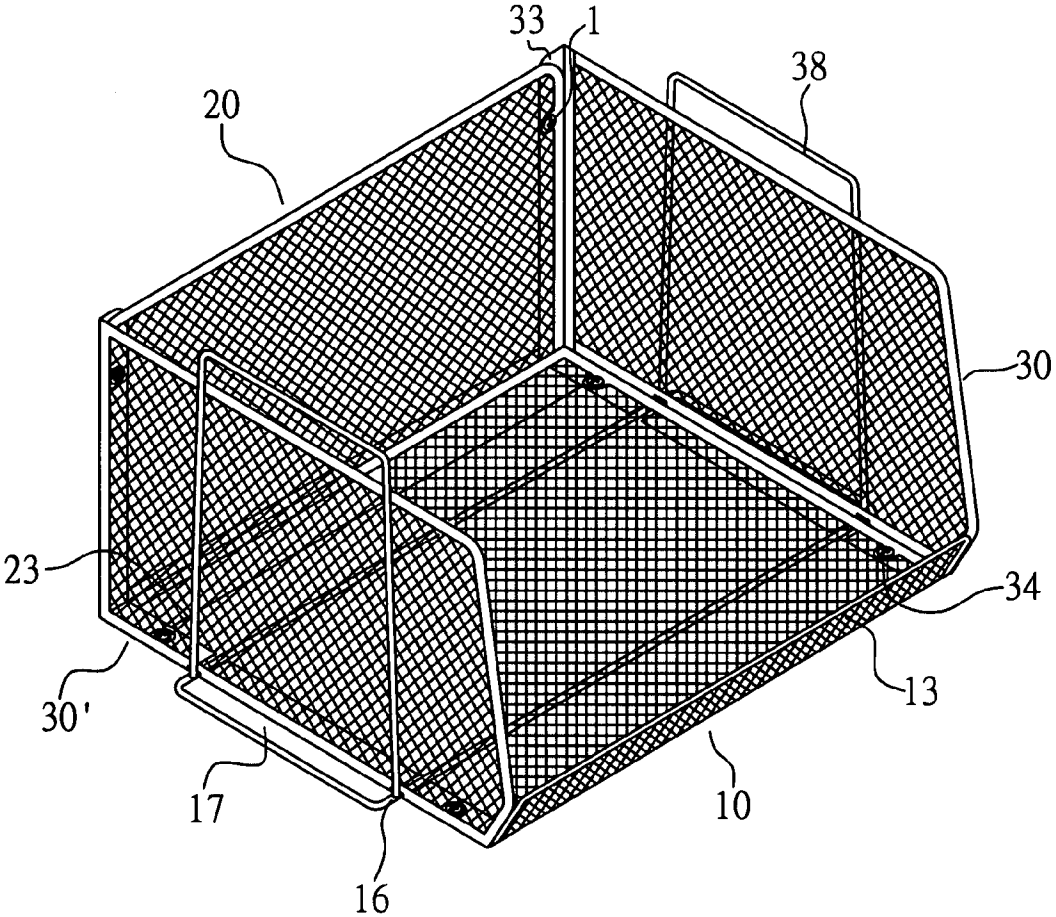
FIG. 1 is a schematic view of a preferred embodiment of the present invention.
Figure 2:
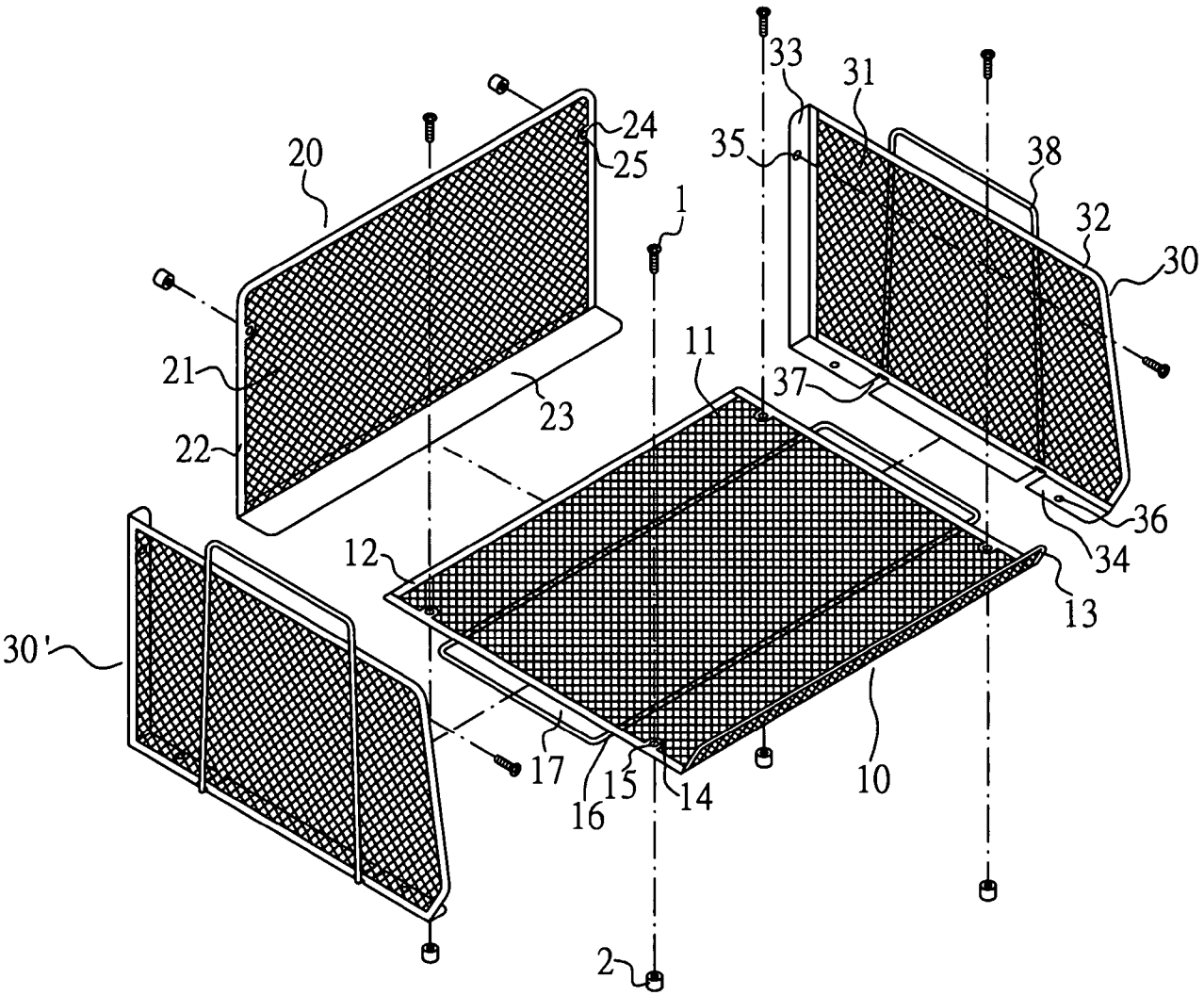
FIG. 2 is an exploded view of the preferred embodiment of the present invention.
Figure 3:
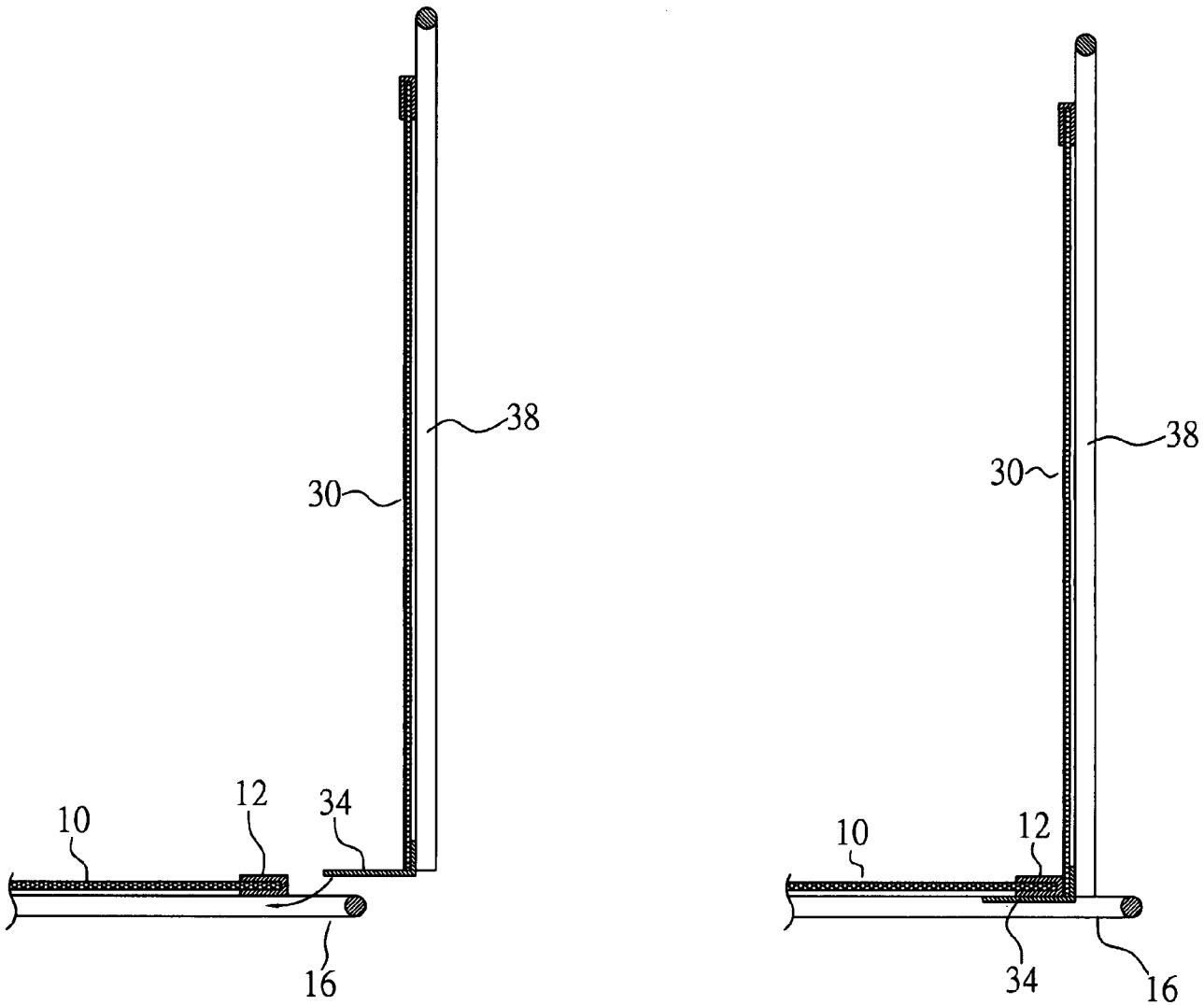
FIG. 3 is a schematic view showing combination of side panel and base panel in the preferred embodiment of the present invention.

Referring to FIGS. 1, 2, and 3, a preferred embodiment of the present invention is essentially comprised of a base panel (10), a back panel (20) and two side panels (30, 30') with multiple bolts (1) and rubber/plastic nuts (2).

Wherein, the base panel (10) includes a grid (11) molded in a preset specification and the peripheral of the grid (11) is soldered with a plate frame (12). The frame (12) covers up the peripheral of the grid (11) to prevent exposure of any end of the grid (11) and multiple (four in this preferred embodiment) connection members (13) each provided with a bolting hole (14) are provided on and integrated with both shorter sides of the base panel (10). An elevated retaining portion (15) in a proper width and is punched at the front edge of the base panel (10). A lateral frame (16) is provided beneath the base panel (10) and the width of the lateral frame (16) is slightly greater than that of the base panel (10) to reserve an insertion area (17) each on both shorter sides of the lateral frame (16).

The back panel (20) includes a grid (21) molded in a preset specification and a plate frame (22) covers up the peripheral of the back panel (20) by soldering. A skirt (23) in enlarged width extends at a right angle from the lower edge of the back panel (20) for the base panel (10) to rest on. Two connection portions (24) each containing a bolting hole (25) are respectively disposed at the upper portions of both sides of the plate frame (22).

Both side panels (30, 30') in symmetric to each other with each includes a grid (31) molded in preset specification before being covered around its peripheral a plate frame (32) by welding. A slope is made to the lower portion in front of the side panel (30, 30') to compromise the retainer (15) of the base panel (10). Two skirts (33, 34) each in proper width respectively extend from the back edge and lower edge of the side panel (30, 30.). The skirt (33) extending from the back edge of the side panel (30, 30') is disposed longitudinally at a right angle to the side panel (30, 30') and a bolting hole (35) is disposed at where corresponding to the connection portion (24) of the back panel (20). The skirt (34) extending from the lower edge of the side panel (30, 30') is disposed horizontally at a right angle to the side panel (30, 30') and a bolting hole (36) is disposed at where corresponding to the connection portion (13) of the base panel (10). Two slots (37) are disposed to the skirt (34) of the side panel (30, 30') for compromising the size of the shorter side of the lateral frame (16) beneath the base panel (10) for the skit (34) to escape the lateral frame (16) when inserted to engage the bottom of the base panel (10). A vertical frame (38) in Π shape is disposed externally to each side panel (30, 30') in a width of its outer diameter merely equal to the width of the inner diameter of the lateral frame (16) and at an level slightly higher than that of the side panel (30, 30').

Accordingly, the base panel (10) rests upon the back panel (20) and is supported by skirt (23) of the back panel (20). Both side panels (30, 30') are inserted to both sides of the base panel (10) by having both reserved slots (37) on the lower skirts (34) of both side panels (30, 30') to bypass the lateral frame (16). Both rear skirts (33) from both side panels (30, 30') hold onto the back of the back panel (20) to complete the preliminary positioning for the storage basket. Finally, multiple bolts (1) in conjunction with multiple nuts (2) secure the back panel (20) through bolting holes (25, 35) corresponding to both side panels (30, 30') and the base panel (10) to both side panels (30, 30') through bolting holes (14, 36) to complete the erection of the basket. In the configuration of the erected basket, a firm and reliable assembly is achieved due to that the base panel (10) is supported by the skirt (23) of the back panel (20), that both lower skirts (34) from both side panels (30, 30') are inserted to where below the base panel (10); and that the back panel (20) is guarded by both rear skirts (33) from both side panels (30, 30'). The stability of the basket is further guaranteed when the basket is fastened with bolts (1) and nuts (2).

Figure 4:
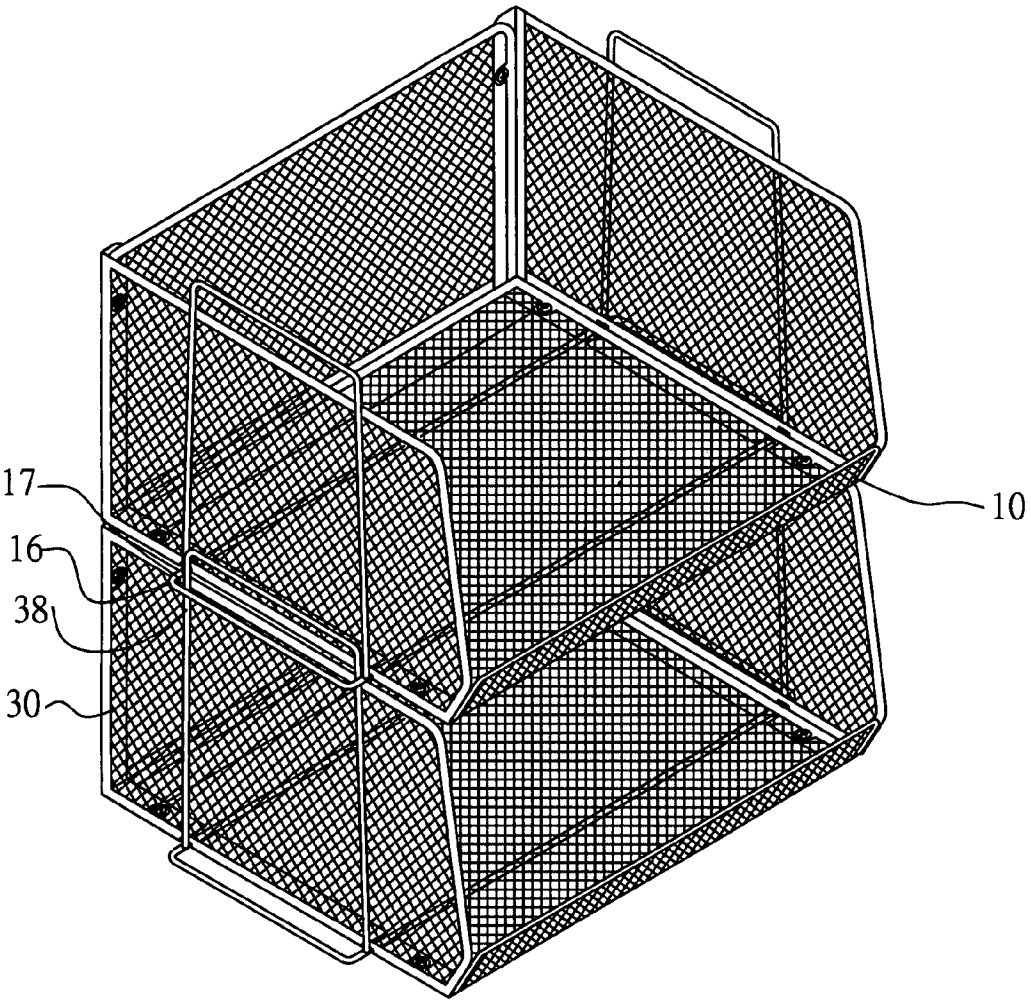
FIG. 4 is a schematic view showing an assembly of the preferred embodiment of the present invention.

As illustrated in FIG. 4, the present invention allows stacking up of multiple units of the basket. The insertion area (17) defined by having greater width of the lateral frame (16) disposed beneath the base panel (10) than that of the base panel (10) in conjunction with the design of having the top of the vertical frame (38) at a level slightly higher than that of the side panel (30, 30') to permit the vertical frames (38) of another basket below to be placed into the insertion areas (17) on both sides of the lateral frame (16) beneath the base panel (10) of the basket on top. The firm construction of the basket allows reliable stacking up of multiple units of the basket without being vulnerable to the shaking and loosening problems found with the prior art, thus to ensure safety and reliability of the contents in those baskets.

The present invention by having plate frame covering up the peripheral of each panel to replace the rod frame of the prior art not only allows easy erection of the basket but also improves quality and appearance of the basket without exposing any end of the grid and free of the problem of easily disengaged grid from its frame when subject to the least external force applied to the basket. Integrated connection portions and bolting holes for locking up the basket with bolts are made feasible thanks to the design of the plate frame. Skirts extending from the back panel and both side panels give additional stability to the entire basket, and further to provide significantly reduced the space when the basket is knocked down to upgrade the practical value of the basket.

Accordingly, the present invention effectively corrects the defects found with the prior art and meet the industrial utility purpose is indeed an excellent and outstanding innovation; therefore, this patent application is duly filed.

The invention claimed is:

1. A combined storage basket including a base panel, a back panel, two side panels, and multiple sets of bolt and nut; each panel being comprised of a grid molded in preset specification with the peripheral covered up with a plate frame by soldering; a skirt extending from the lower edge of the back panel, two connection portions each containing a bolting hole being respectively integrated to the upper portion of the plate frame of the back panel; a rear skirt and a bottom skirt respectively extending at a right angle from the rear edge and the lower edge of each side panel, a bolting hole being disposed to the rear skirt and two bolting holes being disposed to the lower skirt of the side panel, a frame in Π shape being disposed externally to the side panel with the top of the frame at a level higher than that of the side panel and in a width of its outer diameter merely equal to the width of the inner diameter of a lateral frame disposed beneath the base panel, two slots being disposed on the bottom skirt of each side panel to bypass the lateral frame when the base panel is bolted to both side panels; the front edge of the base panel being punched at a certain elevation, the lateral frame being disposed beneath the base panel in a width slightly greater than that of the base panel, both shorter sides of the lateral frame exposed out of both shorter sides of the base panel defining each an insertion area, and two connection portions each containing a bolting hole being integrated with each shorter side plate frame of the base panel.

2. The combined storage basket as claimed in claim 1, wherein, the peripheral of each of the base panel, the back panel, and both side panels is covered up with plate frame; each panel is prefabricated with multiple bolting holes or multiple connection portions each containing a bolting hole to secure all the panels with multiple bolts without the necessity to provide separate locating members.

* * * * *